United States Patent [19]

Hosan et al.

[11] Patent Number: 4,756,496

[45] Date of Patent: Jul. 12, 1988

[54] CONTINUOUSLY ADJUSTABLE LEVELLING COLUMN

[75] Inventors: Hans-Josef Hosan, Neuwied; Axel Knopp, Eitelborn; Herbert Freitag, Koblenz; Peter Schlottermüller, Reinheim, all of Fed. Rep. of Germany

[73] Assignee: Stabilus GmbH, Koblenz-Neuendorf, Fed. Rep. of Germany

[21] Appl. No.: 736,563

[22] Filed: May 21, 1985

[30] Foreign Application Priority Data

Jun. 1, 1984 [DE] Fed. Rep. of Germany ..... 3420528

[51] Int. Cl.[4] ..... F16M 11/00

[52] U.S. Cl. ..... 248/161; 108/144; 108/150; 248/188.5; 248/631; 297/345

[58] Field of Search ..... 248/161, 162.1, 188.2, 248/188.5, 123.1, 297.1, 631; 297/345; 108/144, 150

[56] References Cited

U.S. PATENT DOCUMENTS

| | | | |
|---|---|---|---|
| 2,854,061 | 9/1958 | Romito . | |
| 3,241,801 | 3/1966 | Wilkenloh et al. . | |
| 3,250,509 | 5/1966 | Molloy . | |
| 3,436,048 | 4/1969 | Greer . | |
| 3,711,054 | 1/1973 | Bauer . | |
| 3,788,587 | 1/1974 | Stemmler | 248/631 |
| 3,790,119 | 2/1974 | Bauer . | |
| 3,913,901 | 10/1975 | Molders . | |
| 3,921,952 | 11/1975 | Wirges . | |
| 4,074,887 | 2/1978 | Hale . | |
| 4,108,416 | 8/1978 | Nagase et al. . | |
| 4,113,220 | 9/1978 | Godwin et al. . | |
| 4,139,175 | 2/1979 | Bauer . | |
| 4,183,689 | 1/1980 | Wirges et al. . | |
| 4,283,033 | 8/1981 | Bauer . | |
| 4,580,749 | 4/1986 | Howard | 248/631 |

FOREIGN PATENT DOCUMENTS

| | | | |
|---|---|---|---|
| 0034068 | 8/1981 | European Pat. Off. . | |
| 6923641 | 6/1969 | Fed. Rep. of Germany . | |
| 6604512 | 10/1969 | Fed. Rep. of Germany . | |
| 1801159 | 4/1970 | Fed. Rep. of Germany . | |
| 1913801 | 10/1970 | Fed. Rep. of Germany | 248/161 |
| 7414647 | 10/1974 | Fed. Rep. of Germany . | |
| 7509222 | 7/1975 | Fed. Rep. of Germany . | |
| 2545969 | 11/1976 | Fed. Rep. of Germany . | |
| 7711610 | 9/1977 | Fed. Rep. of Germany . | |
| 7716983 | 9/1977 | Fed. Rep. of Germany . | |
| 2823094 | 12/1979 | Fed. Rep. of Germany | 297/345 |
| 8218078 | 11/1982 | Fed. Rep. of Germany . | |
| 8321916 | 11/1983 | Fed. Rep. of Germany . | |
| 8321901 | 1/1985 | Fed. Rep. of Germany . | |
| 1365427 | 5/1964 | France . | |
| 2444578 | 7/1980 | France . | |
| 619604 | 10/1980 | Switzerland . | |

*Primary Examiner*—David L. Talbott

*Attorney, Agent, or Firm*—Brumbaugh, Graves, Donohue & Raymond

[57] ABSTRACT

A continuously adjustable levelling column for chairs comprises a guide tube having a lower end and an upper end. A telescopic tube is guided within the guide tube and has a tapered upper end portion extending beyond the upper end of the guide tube. A gas spring is accommodated within the telescopic tube. This gas spring is axially fixed within the telescopic tube. The upper end of a container of the gas spring abuts through a distance piece a support face at the upper end of the tapered portion of the telescopic tube. A piston rod passing through the lower end of the gas spring is axially fixed with respect to the lower end of the guide tube. A locking control pin extends through the upper end of the gas spring and is engageable through a transmission pin by a control handle.

20 Claims, 10 Drawing Sheets

CONTINUOUSLY ADJUSTABLE LEVELLING COLUMN

BACKGROUND OF THE INVENTION

Modern chairs and tables are height-adjustable by the aid of continuously height-adjustable levelling units.

STATEMENT OF THE PRIOR ART

In German 'Gebrauchsmuster' No. 83 21 916 there is shown a levelling unit comprising a guide tube having a lower end and an upper end. A telescopic tube is slidably guided within the guide tube. An upper end portion of the telescopic tube is tapered for being accommodated within a tapered socket of e. g. a seat plate. A gas spring is accommodated within the telescopic tube. The upper end of the gas spring container abuts a distance piece accommodated within the tapered end portion of the telescopic tube. The distance piece is axially fixed with respect to the telescopic tube at the transition shoulder from a cylindrical main section of the telescopic tube to the tapered end section. A locking control member passing through the upper end wall of the gas spring container is provided for being acted upon by a control handle directly or through transmission members. The gas spring comprises a piston rod extending through the lower end of the gas spring container and axially fixed to the lower end of the guide tube. In this known construction the relative location of the locking control pin and the control handle is dependent on the axial length of the tapered end portion , the dimensions of the distance piece and the engagement of the distance piece with the tapered end portion. Therefore, variations of said relative location may occur and it is necessary to manufacture all the parts influencing the relative location of the locking control member and the control handle with high precision. In spite of this high precision it is sometimes necessary to control and to readjust this relative position after assembling.

OBJECT OF THE INVENTION

It is an object of the present invention to improve a continuously adjustable levelling unit for chairs, tables and similar articles in such a way that an easily reproducible relative position of the locking control member and the control handle is obtained without undue precision in the manufacturing of the mechanical parts influencing this relative position and without the necessity of control and readjustment.

SUMMARY OF THE INVENTION

In view of the above object a continuously adjustable levelling unit for chairs, tables and similar articles comprises a guide tube having an axis, a first end and a second end. A telescopic tube is slidably guided along said axis within said guide tube and has a first or lower end within the guide tube. A second or upper end portion of the telescopic tube includes a second end of the telescopic tube and extends beyond the second end of the guide tube. This second end portion of the telescopic tube is conically tapered towards the second end of the telescopic tube over at least part of its axial length. A lockable gas spring is provided for assisting relative movement of the guide tube and the telescopic tube in one axial direction. This lockable gas spring includes a container member having an axis and two ends. A piston rod member extends axially through one of said ends, namely the lower end. A locking control member extends axially through the other of said ends, namely the upper end. The container member is substantially coaxially accommodated and axially fixed within the telescopic tube. The piston rod member is axially fixed with respect to the first end or lower end of the guide tube. The other or upper end of the container member is axially supported by the second or upper end portion of the telescopic tube through axial supporting means. These axial supporting means are provided at the second or upper end of the telescopic tube.

In this levelling unit the axial location of the locking control member with respect to the second or upper end of the telescopic tube is substantially constant from levelling unit to levelling unit independently of the axial length and shape of the second end portion of the telescopic tube. Therefore, it is easily possible to obtain a correct relative axial position of the locking control member and the control handle.

While in the known construction as disclosed in German 'Gebrauchsmuster' No. 83 21 916 the outer circumferential face of the container member is in sliding fit engagement with the inner circumferential face of the telescopic tube, according to a further feature of the present invention the container member of the gas spring has an external cylindrical surface radially spaced from an internal cylindrical surface of the telescopic tube. As a result thereof the gas spring is free from bending stresses. The requirements as to the precision of the outer diameter of the container member and as to the precision of the inner diameter of the telescopic tube are small. The replacement of the container member becomes very easy, no readjusting steps being necessary.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWINGS

The invention will now be explained in greater detail by reference to various examples of embodiment, wherein.

DESCRIPTION OF THE PREFERRED EMBODIMENTS

Figure 1:
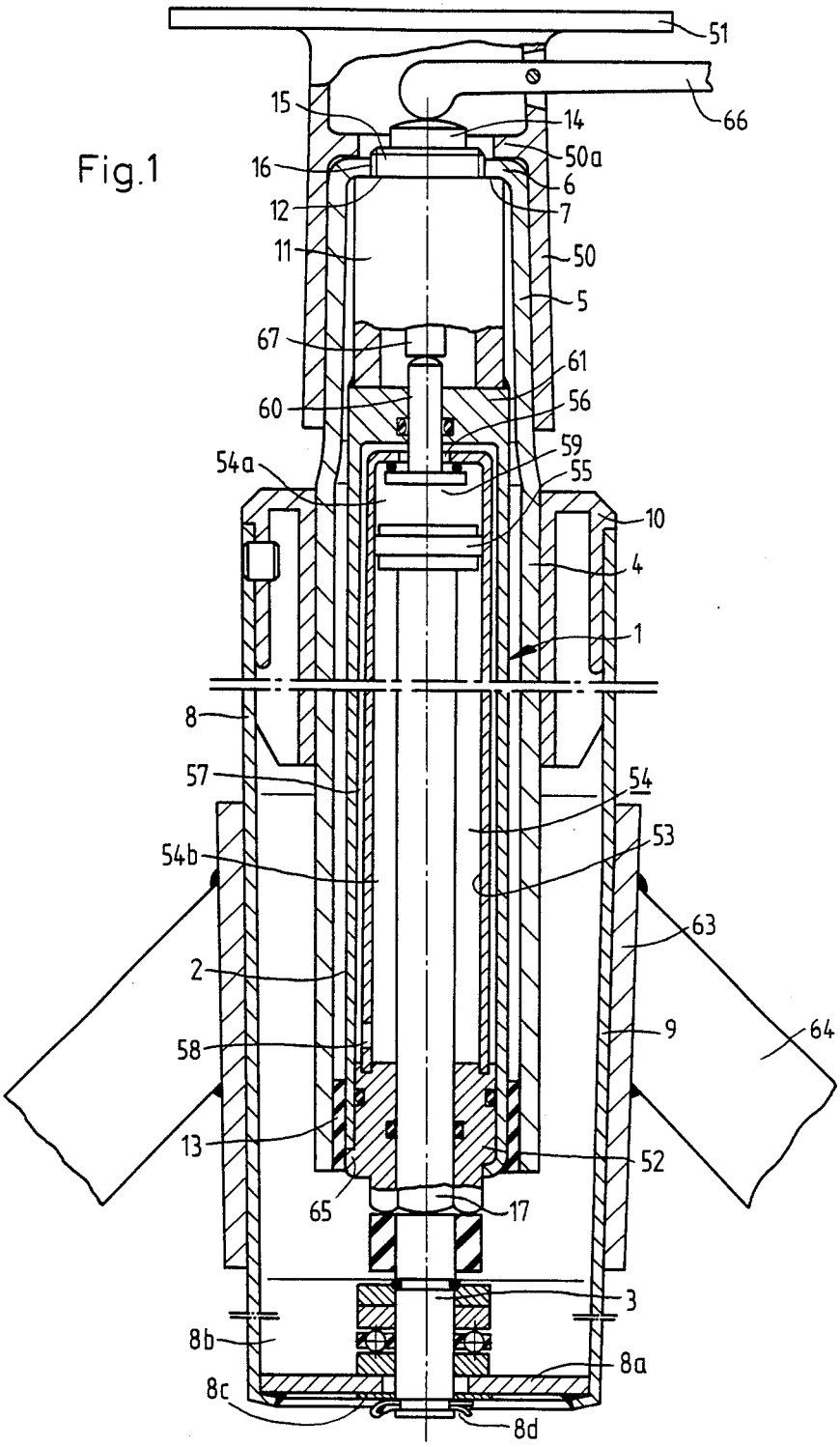
FIG. 1 shows a levelling unit in longitudinal section.

The steplessly adjustable levelling unit for chairs, tables or similar articles as shown in FIG. 1 comprises a blockable gas spring 1, the container 2 of which is connected with a telescopic tube 4, while a piston rod 3 issuing downwards from the blockable gas spring 1 is connected with a guide tube 8 at the bottom 8*a* thereof. The piston rod 3 is supported through an axial bearing 8*b* on the bottom part 8*a* of the guide tube 8 and is connected therewith through a washer 8*c* and a securing split pin 8*d*. The telescopic tube 4, guided in the guide tube 8 by means of a guide bush 10, possesses at its upper end a tapered end portion 5 which serves for securing in a corresponding counter-tapered socket 50 of a chair seat plate 51 or of another article of adjustable height. The upper end of the tapered end portion 5 is provided with a crimped-over flange 6, the lower surface of which forms a stop or support surface 7 for a distance piece 11 firmly connected with the container 2. The distance piece 11 places itself with its upper end face 12 against the stop or support surface 7 when the threading 16, provided on an extension piece 15 of the distance piece 11, is screwed into the corresponding counter-threading at the internal surface of the crimped-over flange 6. The distance piece 11 is fixed to the container 2. The container 2 is arranged at a radial distance from the internal face of the telescopic tube 4 and is centered merely by an elastic distance ring 13 situated at the lower end between the container 2 and the telescopic tube 4.

The piston rod 3 of the gas spring is guided through a piston rod guiding and sealing unit 52 provided at the lower end of the container member 2. Within the container 2 there is provided an inner cylinder 53 which defines a cavity 54 therein. The piston rod 3 is provided within the cavity 54 with a piston 55 which separates the cavity 54 into two working chambers 54*a* and 54*b*. The two working chambers 54*a* and 54*b* are interconnected by a passage system comprising a perforation 56 in the upper end wall of the inner cylinder 53, an annular chamber 57 and a perforation 58 in the inner cylinder 53. This passage 56, 57, 58 is closeable by a valve unit 59. This valve unit 59 comprises a locking control pin 60 extending through an upper end wall 61 of the container 2. A pressurized gas is contained within the working chambers 54*a* and 54*b*. When the valve unit 59 is in the closed condition as shown in FIG. 1 the working chambers 54*a* and 54*b* are separated from each other and the gas spring is blocked so that also the telescopic tube 4 is blocked with respect to the guide tube 9. If the valve unit 59 is opened against the pressure of the gas within the working chamber 54*a* the working chambers 54*a* and 54*b* are interconnected so that due to the pressure of gas acting onto the cross-sectional area of the piston rod member 3 the piston rod is urged downwards with respect to the container 2 or with other words: the container 2 and the telescopic tube 4 are urged upwards with respect to the piston rod 3 and the guide tube 8.

The guide tube 8 is provided with a tapered section 9. This tapered section 9 is in engagement with a sleeve 63 of a foot member 64. In view of fixing the gas spring 1 within the telescopic tube 4 by the threading 16 key faces 17 are provided at the lower end of the piston rod guiding and sealing unit which is connected for common rotation with the container member 2 by a radially projecting cam 65 engaging a recess of the container member 2. A control handle, namely a two-armed lever 66 is pivotally mounted in the socket 50 and acts upon a plunger 14 which acts on the locking control pin 60 through a transmission pin 67.

Due to the engagement of the upper end face 12 of the distance piece 11 with the lower stop or support surface of the crimped-over flange 6 a precise axial positioning of the locking control pin 60 with respect to the upper end of the tapered portion 5 of the telescopic tube 4 is obtained and this is also true for the axial position of the locking control pin 60 with respect to the control handle 66 when the flange 50*a* of the socket 50 is in engagement with the flange 6 of the tapered portion 5.

Since for example when a chair of adjustable height is assembled the taper connection 5, 50 cannot readily be disengaged and likewise the taper connection 9, 63 between the foot part and the guide tube 8 cannot readily be disengaged, in the case of any defect the gas spring must be easily dismantlable. For this purpose in a simple manner the split pin 8*d* is drawn out of the piston rod 3 and the foot part 64 with the guide tube 8 is removed from the piston rod 3. Then a spanner is applied to the spanner or key faces 17 and the gas spring 1 is screwed out of the telescopic tube 4 by screwing open the threading 16. The new gas spring is then screwed with the threading 16, situated on the extension piece 15 of the distance piece, into the corresponding threading in the region of the crimped-over flange 6 of the telescopic tube and pressed firmly with the end face 12 against the stop face 7 by rotation of the spanner acting on the spanner or key faces 17. Then the telescopic tube 4 with the blockable gas spring 1 is introduced into the guide bush 10 of the guide tube 8 and the piston rod is secured in the bottom wall 8*a* of the guide tube 8 by means of the washer 8*c* and securing split pin 8*d*.

Figure 2:
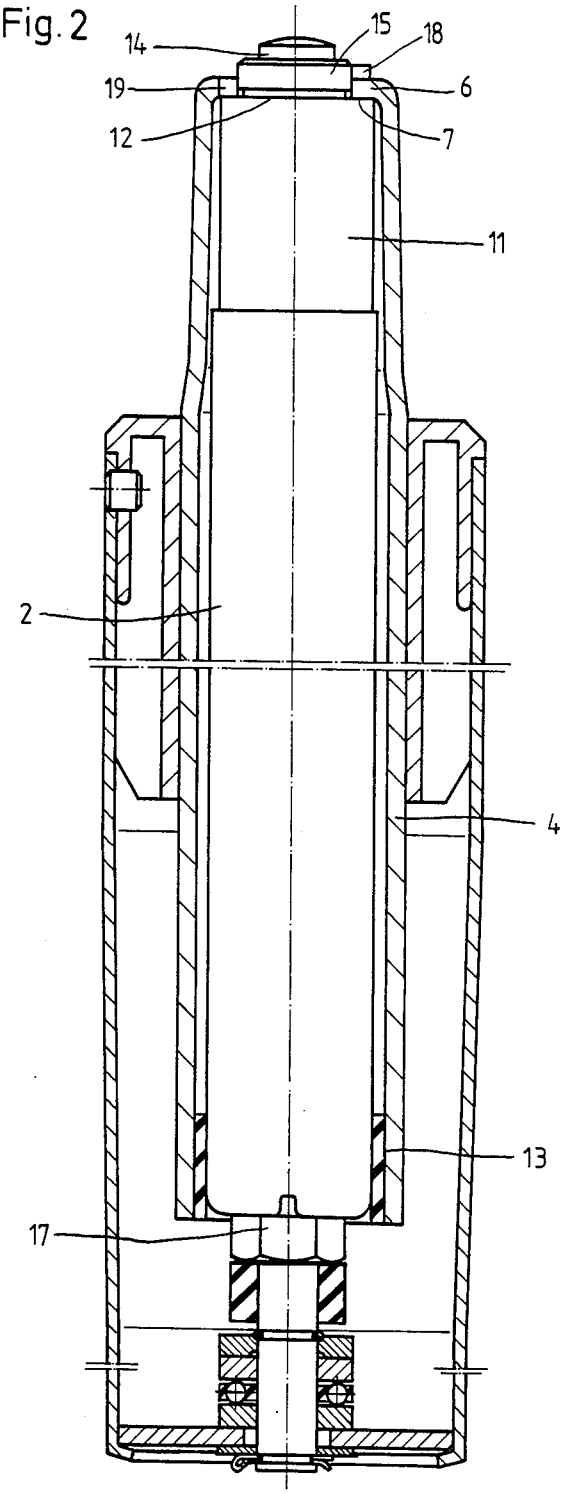
FIG. 2 shows a levelling unit with a slide catch or bayonet catch-type securing of the gas spring in the telescopic tube, in longitudinal section.

The form of embodiment according to FIG. 2 differs from that according to FIG. 1 essentially in that the distance piece 11 firmly connected with the container 2 has on its extension piece 15 at least one projection 18 of cam form which can be conducted through a corresponding recess 19 in the region of the flange 6 and a slide catch or bayonet catch-type securing of the gas spring in the telescopic tube 4 is effected by rotation of the container 2. The end face 12 of the distance piece 11 is thereby pressed firmly against the stop face 7. For the application of the force necessary for rotation an extension piece provided with key faces 17 is present fast in rotation likewise at the lower end of the container 2. For the centering of the blockable gas spring secured with radial play in the telescopic tube 4 a distance ring 13 is provided between the container 2 and the internal face of the telescopic tube 4. This distance ring 13 can be made as an elastic synthetic plastics ring. The replacement of the gas spring takes place in the same manner as described with reference to the form of embodiment according to FIG. 1. The sole difference consists in that the rotating movement does not screw open a threading but the movement guides the projection 18 of cam form through the recess 19 and by rotation brings it to abut on the upper end face of the crimped-over flange 6. In this arrangement again the required axial location of the locking control pin (not shown) and the plunger 14 is guaranteed without subsequent adjustment.

Figure 3:
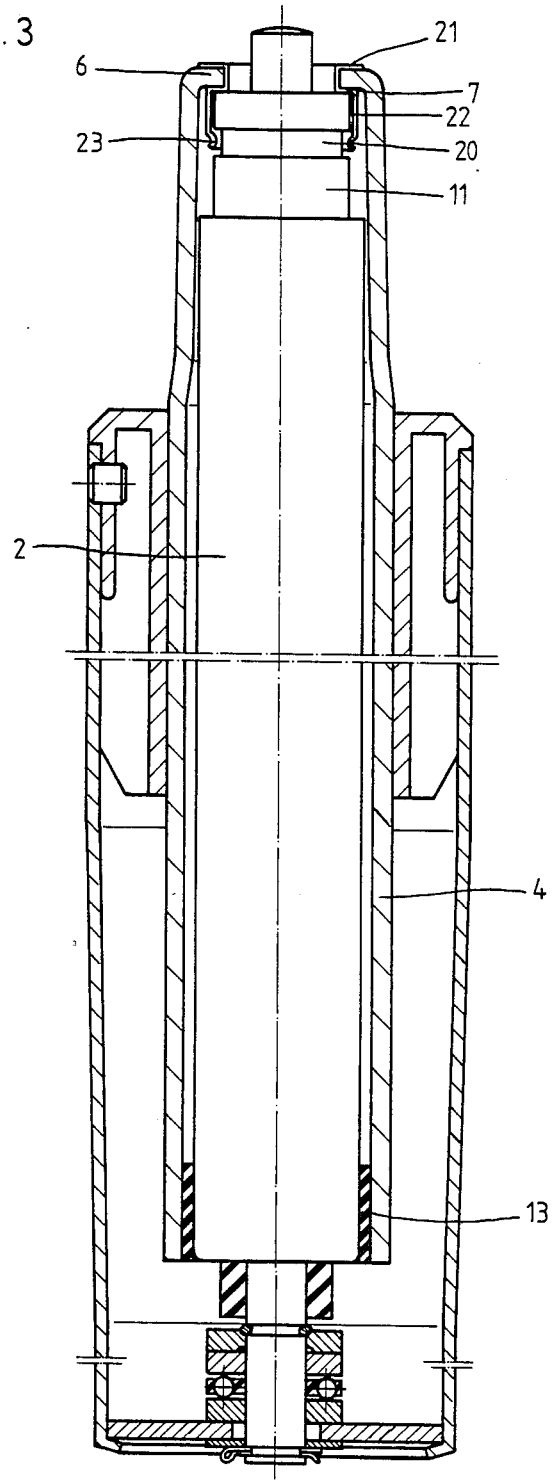
FIG. 3 shows an axial fixation of the gas spring in the telescopic tube by a spring clip.

FIG. 3 shows a force-engaging connection of the container 2 with the telescopic tube 4. In this case a spring clip 21 is snapped in at the crimped-over flange 6, that is in the region of the stop or support face 7, and thus firmly connected with the telescopic tube 4. The distance piece 11 connected firmly with the container 2 is provided with a circumferential groove 20 in which spring tongues 22 of the spring clip 21 engage with inwardly directed projections 23 when the gas spring is in the position fully pushed into the telescopic tube. The centering of the container 2 in the telescopic tube 4 is again effected by a distance ring 13 situated at the lower end between the container 2 and the inner circumferential face of the telescopic tube 4. The disengagement of the container 2 from the telescopic tube 4 is effected by an extraction force overcoming the retention of the spring clip 21, generated for example by a greater jerk-type extraction force upon the chair seat carrier.

Figure 4:
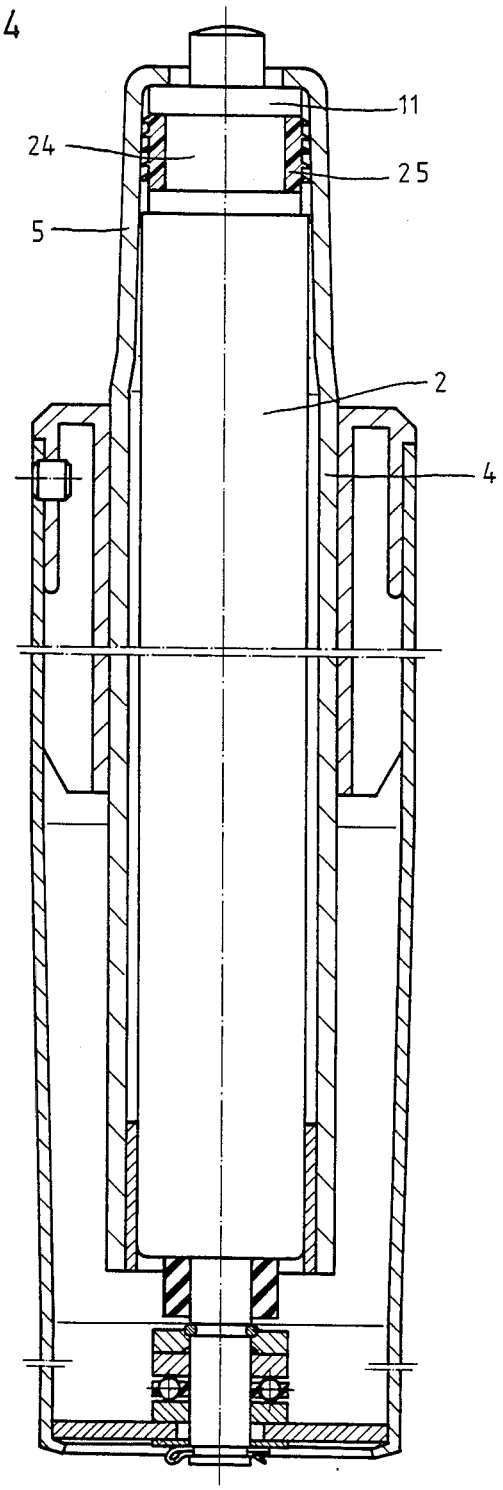
FIG. 4 shows an axial fixation of the gas spring in the telescopic tube by a clamp ring.

A further force-engaging connection of the container 2 with the telescopic tube 4 is represented in FIG. 4. In this case a reception groove 24 in which a clamp ring 25 is arranged is provided in the distance piece 11 connected fast with the container 2. This clamp ring has annular toothings so that these claw themselves fast on the inner surface of the tapered end portion 5 when the container 2 is pressed into the telescopic tube 4. Here again, as described above with reference to the form of embodiment according to FIG. 3, an extraction force between telescopic tube 4 and container 2 is necessary for the disengagement of the gas spring.

Figure 5:
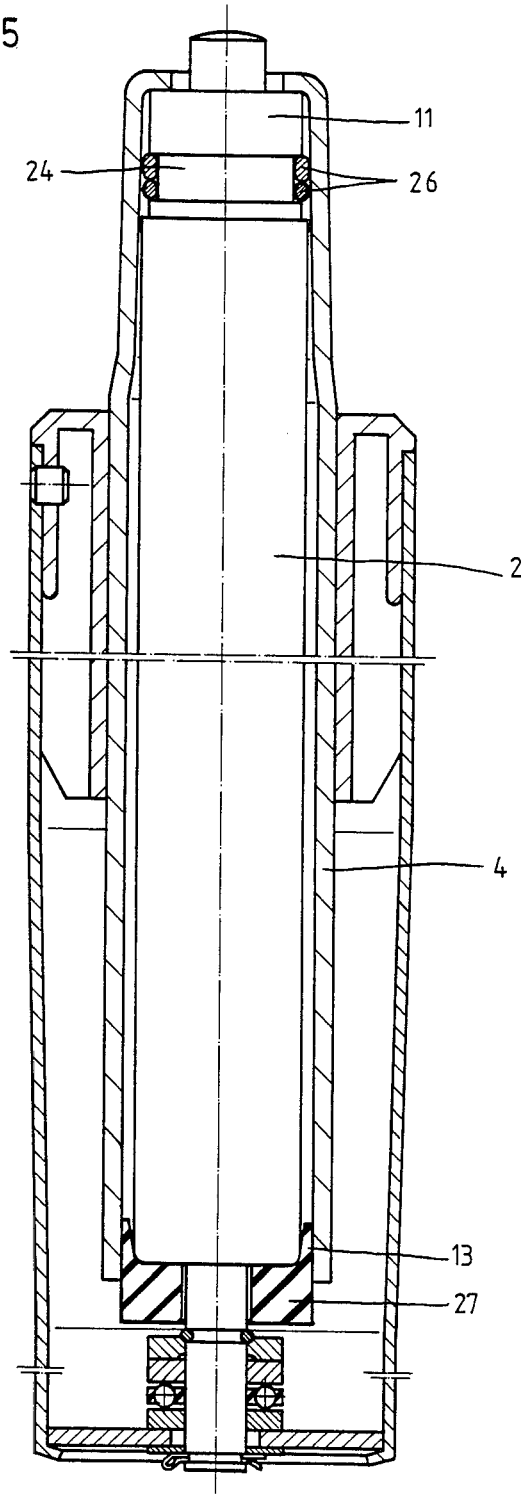
FIG. 5 shows an axial fixation of the gas spring in the telescopic tube by means of O-rings.

Similarly a force-engaging connection between the container 2 of the gas spring and the telescopic tube 4 is shown in FIG. 5. For this purpose O-rings 26 are inserted in the reception groove 24 of the distance piece 11 firmly connected with the container 2 and generate a force-engaging connection with the opposite internal surface. At the lower end of the container 2 there is a rubber buffer 27 which at the same time forms the distance ring 13 between the container 2 and the telescopic tube 4.

Figure 6:
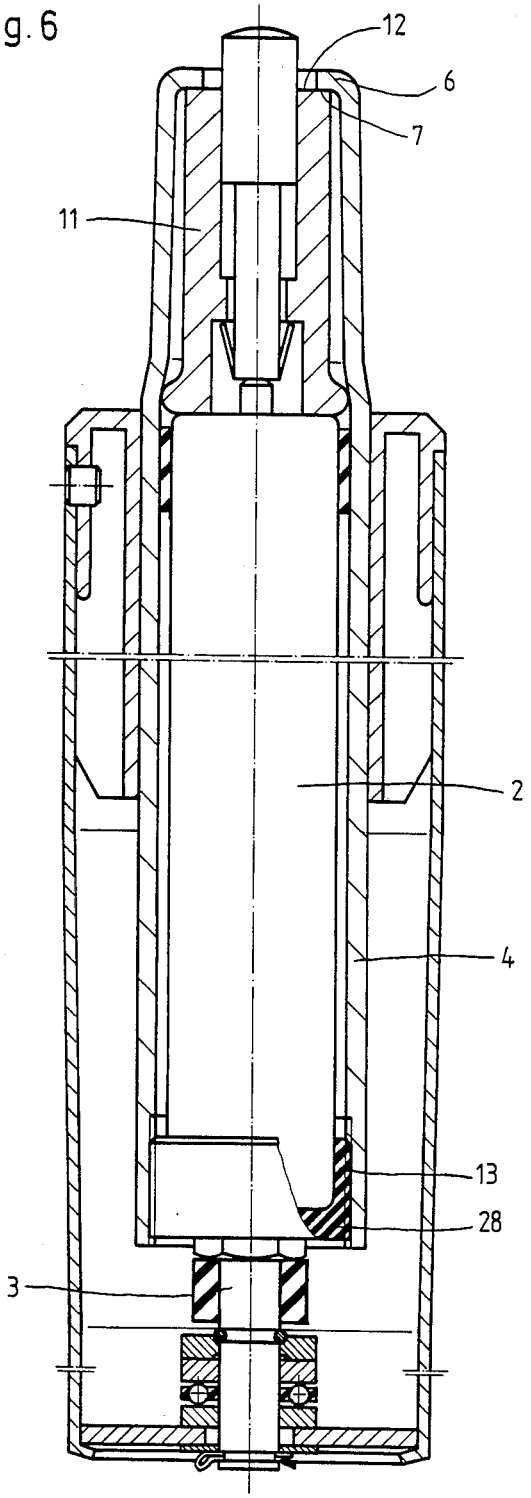
FIG. 6 shows a levelling unit in longitudinal section where an annular fastening member is provided for axial fixation of the gas spring at the lower end of the telescopic tube.

In the form of embodiment as shown in FIG. 6 the container 2 of the gas spring is secured in the telescopic tube 4 by a fastening screw member 28 provided with spanner faces and arranged at the exit of the piston rod 3 from the container. This externally threaded fastening screw member 28 is screwed into a corresponding internal threading of the telescopic tube 4 and tightened by a spanner acting on the spanner faces of the fastening screw member 28. The distance piece 11 is here pressed with the end face 12 against the stop 7 formed by the crimped-over flange 6. The securing screw 28 is here combined with a distance ring 13 and preferably nondetachably connected with the container 2.

Figure 7:
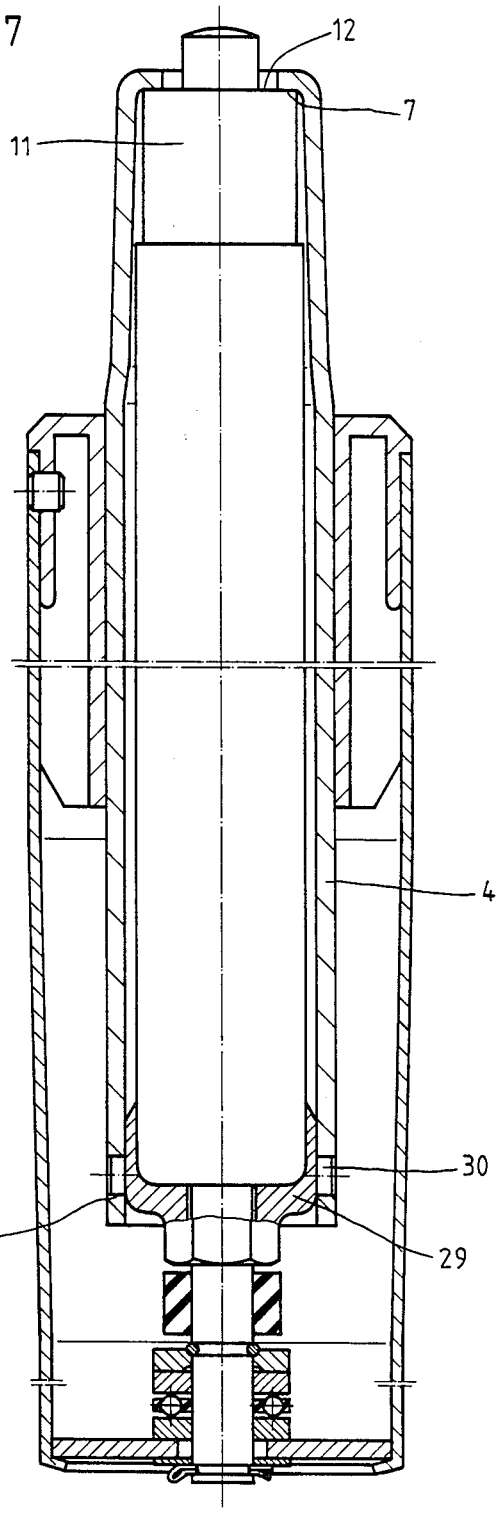
FIG. 7 shows a bayonet or slide catch connection between the gas spring container and the telescopic tube at the lower end thereof.
Figure 7A:
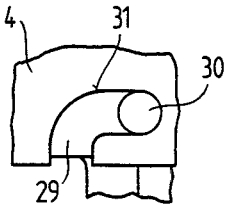
FIG. 7*a* shows a detail of FIG. 7 according to arrow VIIa of FIG. 7.

In place of a fastening screw member it is readily also possible to use a fastening member of the slide catch or bayonet catch-type, as shown in FIG. 7 and 7*a*. In this case the fastening member 29 is provided with radial projections 30 which engage in corresponding recesses 31 in the telescopic tube 4. The recesses 31 are in this case formed so that firstly pushing in axially is effected until the distance piece 11 abuts with the end face 12 on the stop face 7 and then retention in this position is effected by rotation.

Figure 8:
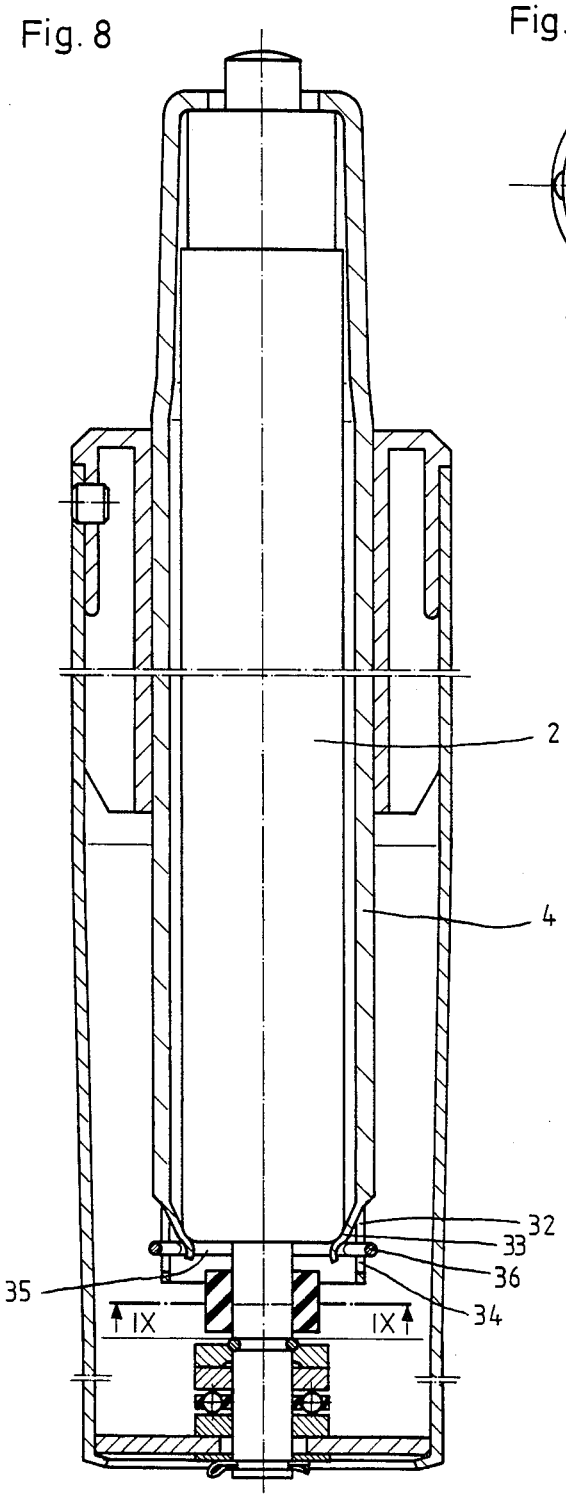
FIG. 8 shows an axial fixation of the gas spring within the telescopic tube by securing tabs punched out from the telescopic tube.

The form of embodiment according to FIG. 8 shows a telescopic tube 4 which has a section 32 of slighter wall thickness at its lower end. In the region of this section there are provided several inwardly directed, punched-out tabs 33 distributed over the circumference which come to abut at the lower end of the container 2. A securing clip 35 is provided with formed-on portions 36 and engages therewith through recesses 34 which are produced by the forming of the tabs 33. This securing clip 35 prevents springing back of the inwardly directed tabs 33 so that the container 2 is held in the position as illustrated. This securing clip 35, preferably made from round wire, can easily be removed by hand when the guide tube is dismantled, so that the gas spring can easily be withdrawn from the telescopic tube 4.

Figure 9:
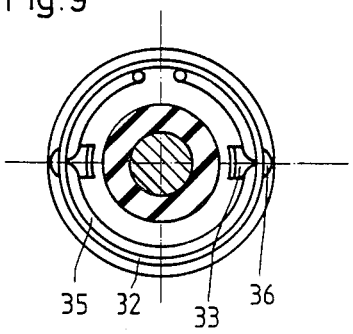
FIG. 9 shows a cross-section according to line IX—IX of FIG. 8.

FIG. 9 illustrates the arrangement of the securing clip 35 according to FIG. 8.

Figure 10:
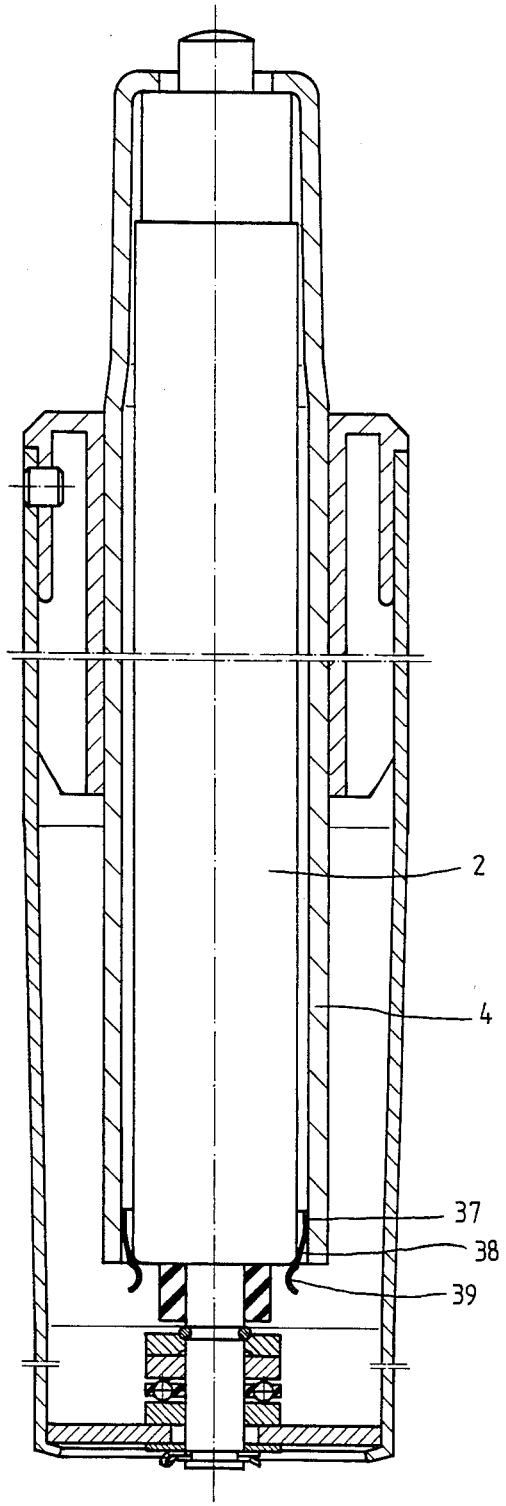
FIG. 10 shows a fixation of the gas spring within the telescopic tube by a spring clip arranged at the lower end of the telescopic tube.
Figure 11:
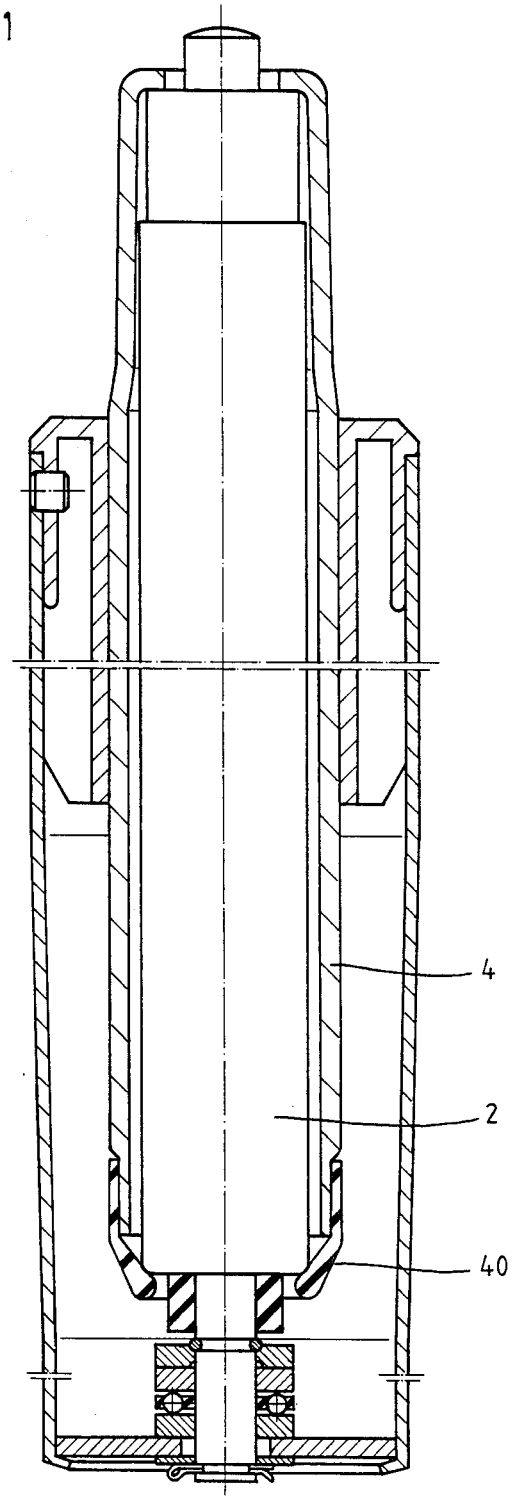
FIG. 11 shows a fixation of the gas spring within the telescopic tube by an elastic clamp sleeve.

In FIGS. 10 and 11 there are shown force-engaging fastenings of the container 2 in the telescopic tube 4. According to FIG. 10 a spring clip 37 is secured on the internal surface of the telescopic tube 4 and downwardly pointing spring tongues 38 grasp with the inwardly pointing projections 39 over the lower end of the container 2 and hold it fast in the position as illustrated. In this case the spring tongues 38 form an elastic distance ring. In FIG. 11 a clamp sleeve 40, the lower end of which grasps over the end of the container 2, is secured on the external surface of the telescopic tube 4. This clamp sleeve 40 is preferably made from synthetic plastics material and secured firmly on the telescopic tube 4 by means of a shrunk connection. For the release of the container 2 from the telescopic tube 4 it is merely necessary to apply an extraction force to the telescopic tube 4 which is greater than the retention force of the spring clip 37 or the clamp sleeve 40.

While specific embodiments of the invention have been shown and described in detail to illustrate the application of the inventive principles, it will be understood that the invention may be embodied otherwise without departing from such principles.

It is to be noted that the reference numbers in the claims are only provided in view of facilitating the understanding of the claims. These reference numbers are by no means to be understood as restrictive.

What is claimed is:

1. A continuously adjustable levelling unit for chairs, tables and similar articles comprising:

a guide tube having an axis, a first end (8*a*) and a second end;

a telescopic tube slideably guided along said axis within said guide tube and having a first end within said guide tube, a second end portion (5) with a second end (6) adjacent said second end of said guide tube (8) and extending beyond said second end of said guide tube (8), said second end portion (5) of said telescopic tube (4) being conically tapered towards said second end (6) of said telescopic tube (4) over at least part of its axial length;

a blockable gas spring (1) including a container member (2) having an outer cylindrical face, an axis and two ends (52, 61), a piston rod member (3) axially extending through one (52) of said ends, a blocking control member (60) axially extending through the other (61) of said ends, said container member (2) being axially fixed within said telescopic tube (4) by an annular fastening member (28, 13) located adjacent said first end of said telescopic tube (4) so as to surround said piston rod member (3), said annular fastening member being shorter than said container member and engageable with said telescopic tube (4) by rotatable engagement means substantially coaxially with said telescopic tube (4) so as to be substantially coaxially accommodated within said telescopic tube (4) and act axially onto a substantially axially directed end face defining said one end of said container member (2), said piston rod member (3) passing through a bore of said annular fastening member (28, 13) having a diameter smaller than the diameter of said outer cylindrical face and being axially fixed with respect to the first end (8*a*) of said guide tube (8), the other end (61) of said container member (2) being axially supported adjacent said second end portion (5) of said telescopic tube (4) by axial supporting means (6) so that said container member (2) is axially fixed between said axial supporting means (6) and said annular fastening member (28, 13).

2. A leveling unit as defined in claim 1, wherein said piston rod (3) is provided with a piston unit (55) within a cavity in said container member (2), said piston unit (55) subdividing said cavity into two working chambers (54*a*, 54*b*), said working chambers (54*a*, 54*b*) containing pressurized gas and being interconnected by passage means, said passage means including valve means (59) controllable by said blocking control member (60) for selectively closing and opening said passage means.

3. A continuously adjustable levelling unit for chairs, tables and similar articles comprising:

a guide tube (8) having an axis, a first end (8*a*) and a second end;

a telescopic tube (4) slideably guided along said axis within said guide tube (8) and having a first end within said guide tube (8), a second end portion (5) with a second end (6) adjacent said second end of said guide tube (8) and extending beyond said second end of said guide tube (8), said second end portion (5) of said telescopic tube (4) being conically tapered towards said second end (6) of said telescopic tube (4) over at least part of its axial length;

a blockable gas spring (1) including a container member (2) having an axis and two ends (52, 61), a piston rod member (3) axially extending through one (52) of said ends, a blocking control member (60) axially extending at the other (61) of said ends, said container member (2) being axially fixed within said telescopic tube (4) by rotatable securing means (13, 28) substantially coaxial with said telescopic tube (4), so as to be substantially coaxially accommodated within said telescopic tube (4), said rotatable securing means being selectively engageable and releasable by a torque transmission member (17) which extends beyond said first end of said telescopic tube (4).

4. A leveling unit as defined in claim 3, wherein said torque transmission member (17) is provded with one of torque application faces and spanner faces.

5. A continuously adjustable levelling unit for chairs, tables and similar articles comprising:

a guide tube having an axis, a first end and a second end;

a telescopic tube slideably guided along said axis within said guide tube and having a first end within said guide tube, a second end portion with a second end adjacent said second end of said guide tube and extending beyond said second end of said guide tube, said second end portion of said telescopic tube being conically tapered towards said second end of said telescopic tube over at least part of its axial length;

a blockable gas spring including a container member having an outer cylindrical face, an axis and two ends, a piston rod member axially extending through one of said ends, a blocking control member axially extending at the other of said ends, said container member being axially fixed within said telescopic tube by an annular fastening member located adjacent said first end of said telescopic tube so as to surround said piston rod member, said annular fastening member being shorter than said container member and engageable with said telescopic tube by rotatable engagement means substantially coaxially with said telescopic tube so as to be substantially coaxially accommodated within said telescopic tube and act axially against said one end of said container member, said piston rod member passing through a bore of said annular fastening member having a diameter smaller than the diameter of said outer cylindrical face, and said piston rod member being axially fixed with respect to the first end of said guide tube, the other end of said container member being axially supported adjacent said second end portion of said telescopic tube by axial supporting means so that said container member is axially fixed between said axial supporting means and said annular fastening member, said annular fastening member having faces for the application of torque which extend beyond said first end of said telescopic tube.

6. A continuously adjustable levelling unit for chairs, tables and similar articles comprising:

a guide tube (8) having an axis, a first end (8*a*) and a second end;

a telescopic tube (4) slideably guided along said axis within said guide tube (8) and having a first end within said guide tube (8), a second end portion (5) with a second end (6) adjacent said second end of said guide tube (8) and extending beyond said second end of said guide tube (8);

a blockable gas spring (1) including a container member (2) having an outer cylindrical face, an axis and two ends (52, 61), a piston rod member (3) axially extending through one (52) of said ends, a blocking control member (60) axially extending at the other (61) of said ends, said container member (2) being axially fixed within said telescopic tube (4) by an annular fastening member (28, 12) located adjacent said first end of said telescopic tube (4) so as to surround said piston rod member (3), said annular fastening member being shorter than said container member and engageable with said telescopic tube (4) by rotatable engagement means substantially coaxially with said telescopic tube (4) so as to be substantially coaxially accommodated with said telescopic tube (4) and act axially against said one end of said container member (2), said piston rod member (3) passing through a bore of said annular fastening member (28, 13) having a diameter smaller than the diameter of said outer cylindrical face, said piston rod member (3) being axially fixed with respect to the first end (8*a*) of said guide tube (8), the other end (61) of said container member (2)

being axially supported adjacent said second end portion (5) of said telescopic tube (4) by axial supporting means (6) so that said container member (2) is axially fixed between said axial supporting means (6) and said annular fastening member (28, 13).

7. A leveling unit as defined in claim 1 or 6, wherein said annular fastening member (28, 13) is provided with faces for the application of torque (17) which extend beyond said first end of said telescopic tube.

8. A leveling unit as defined in claim 1 or 6, wherein said annular fastening member (28, 13) is provided so as to extend beyond said first end of said telescopic tube (4).

9. A leveling unit as defined in claim 1 or 6, wherein said annular fastening member (28, 13) is provided with faces (17) for the application of torque.

10. A levelling unit as set forth in claim 1, 5 or 6, said annular fastening member (28, 13) acting as radial centering means radially centering said container member (2) with said telescopic tube (4).

11. A levelling unit as set forth in claim 1, 5 or 6, said annular fastening member (28, 13) being non-detachably fixed to said container member (2).

12. A leveling unit as defined in claim 1, 5 or 6, wherein said annular fastening member (28, 13) has an axial length smaller than the diameter of said outer cylindrical face.

13. A levelling unit as defined in claim 1, 5 or 6, wherein said annular fastening member (28,13) includes a bottom portion (28), provided so as to act onto said substantially axially directed end face, and a distance ring (13) integral with said bottom portion so as to surround a portion of said outer cylindrical face, said distance ring being provided with rotatable engagement means on its external surface for engaging counter rotatable engagement means provided on an internal face of said telescopic tube (4).

14. A leveling unit as defined in claim 1, 5 or 6, wherein said axial supporting means (6) is provided at said second end of said telescopic tube (4).

15. A leveling unit as defined in claim 14, wherein said axial supporting means (6) and said second end portion (5) of saId telescopic tube (4) are formed as a single common piece.

16. A leveling unit as defined in claim 15, wherein said axial supporting means (6) is provided as a radially inwardly crimped-over flange of said second end portion (5) at said second end of said telescopic tube (4).

17. A levelling unit as defined in claim 1, 3, 5 or 6 wherein said outer cylindrical face of said container member has radial distance from said telescopic tube (4) between said two ends of said container member (2), said container member (2) being radially centered with respect to said telescopic tube (4) adjacent to the ends of said container member (2).

18. A continuously adjustable levelling unit as defined in claim 1, 3, 5 or 6, wherein said container member (2) has an outer cylindrical face with a predetermined constant diameter substantially along a major portion of its length, and an end portion of said container has said predetermined diameter extending into said second end portion (5) of said telescopic tube (4) where said telescopic tube (4) is tapered.

19. A subassembly for a continuously adjustable levelling unit for chairs, tables and like articles including a guide tube having a first end adjacent a supporting surface for said unit and a second end adjacent said article, the subassembly comprising:

a telescopic tube adapted to be slideably guided along the guide tube axis and having a first end adapted to extend within the guide tube towards the first end thereof and a second end adapted to extend beyond the second end of the guide tube;

a blockable gas spring including a container member having an outer cylindrical face, an axis and two ends, a piston rod member axially extending through one of said ends, a blocking control member provided so as to axially extend at the other of said ends, said container member being axially fixed within said telescopic tube by an annular fastening member located adjacent said first end of said telescopic tube so as to surround said piston rod member, said annular fastening member being shorter than said container member and engageable with said telescopic tube by rotatable engagement means substantially coaxially with said telescopic tube so as to be substantially coaxially accommodated within said telescopic tube and act axially against said one end of said container member, said piston rod member passing through a bore of said annular fastening member having a diameter smaller than the diameter of said outer cylindrical face and adapted to be axially fixed with respect to the first end of the guide tube, the other end of said container member being axially supported adjacent said second end portion of said telescopic tube by axial supporting means so that said container member is axially fixed between said axial supporting means and said annular fastening member.

20. A subassembly as defined in claim 19, wherein said continer member has an outer cylindrical face with a predetermined constant diameter substantially along a major portion of its length, and an end portion of said container has said predetermined diameter extending into said second end portion of said telescopic tube where said telescopic tube is tapered.

* * * * *